US011140991B1

(12) United States Patent
Brekke et al.

(10) Patent No.: US 11,140,991 B1
(45) Date of Patent: Oct. 12, 2021

(54) INTERNALLY SUPPORTED CUSHION FOR SEATING SYSTEM

(71) Applicant: Haworth, Inc., Holland, MI (US)

(72) Inventors: Craig W. Brekke, Rockford, MI (US); Stephen J. Simpson, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 16/987,660

(22) Filed: Aug. 7, 2020

(51) Int. Cl.
*A47C 7/02* (2006.01)
*A47C 7/18* (2006.01)
*A47C 7/20* (2006.01)

(52) U.S. Cl.
CPC ..... *A47C 7/20* (2013.01); *A47C 7/185* (2013.01); *A47C 7/021* (2013.01)

(58) Field of Classification Search
CPC ..... A47C 7/021; A47C 7/185; A47C 7/20; A47C 13/005
USPC ..... 297/440.1, 440.14, 440.15, 440.16, 297/452.31–452.39, 452.48, 452.57
See application file for complete search history.

(56) References Cited

U.S. PATENT DOCUMENTS 2,769,485 A * 11/1956 Shapiro ..... A47C 7/20 297/452.32
2,853,122 A * 9/1958 Shapiro ..... B60N 2/707 297/452.31
2,976,916 A * 3/1961 Schladermundt ..... A47C 7/185 297/452.32 X
3,084,980 A * 4/1963 Lawson ..... A47C 7/20 297/452.57
3,197,255 A * 7/1965 Caudill ..... A47C 7/425 297/452.36 X
RE25,943 E * 12/1965 Lawson ..... A47C 7/20 297/452.57
3,406,411 A * 10/1968 La Reis ..... A47C 7/16 297/452.38 X
3,534,129 A * 10/1970 Bartel ..... B29C 44/086 297/452.37 X
3,642,323 A * 2/1972 Taylor ..... A47C 5/125 297/452.37 X
3,697,133 A * 10/1972 Wolofski ..... B60N 2/7029 297/452.32
3,833,260 A * 9/1974 Harder, Jr. ..... A47C 7/18 297/452.37 X (Continued)

FOREIGN PATENT DOCUMENTS

EP 407361 A1 * 1/1991 ..... A47C 7/18
EP 0595310 A1 * 5/1994 ..... A47C 4/028
JP 4722618 B2 * 7/2011 ..... A47C 4/028

*Primary Examiner* — Rodney B White
(74) *Attorney, Agent, or Firm* — Warner Norcross + Judd LLP

(57) ABSTRACT

An internally supported cushion for a seating unit is provided. The internally supported cushion includes an internal structure that provides rigidity when used adjacent a back upright or a side upright of a seating unit. The internal structure generally includes a rigid core element that is sandwiched between foam layers. The rigid core element is approximately upright and extends in the lengthwise and widthwise directions of the internally supported cushion. A batting layer is positioned immediately beneath an upholstery covering to prevent the covering from contacting the internal foam layers, which encapsulate the rigid core element.

15 Claims, 10 Drawing Sheets

(56) References Cited

U.S. PATENT DOCUMENTS 3,833,454 A * 9/1974 Ambrose ..... B29C 44/1209 297/452.57 X
4,026,567 A 5/1977 Rye
4,607,887 A * 8/1986 Vail ..... A47C 7/18 297/452.57 X
4,632,459 A * 12/1986 Herschlag ..... A47C 4/028 297/440.1 X
4,702,522 A * 10/1987 Vail ..... A47C 7/18 297/452.57 X
4,711,495 A * 12/1987 Magder ..... A47C 4/028 297/452.58 X
4,753,480 A * 6/1988 Morell ..... A47C 27/148 297/452.27
4,755,000 A * 7/1988 Chiaro ..... A47C 31/02 297/440.15
4,835,801 A * 6/1989 Walpin ..... A47C 7/425 297/452.37
4,960,304 A * 10/1990 Frantz ..... A47C 7/021 297/452.32 X
5,000,512 A * 3/1991 Laird ..... A47C 4/02 297/440.1 X
5,112,110 A * 5/1992 Perkins ..... A47C 4/028 297/440.15 X
6,033,024 A * 3/2000 Pfau ..... A47C 7/26 297/452.35 X
6,151,765 A * 11/2000 Asplund ..... B60N 2/206 297/440.16 X
6,783,182 B1 * 8/2004 Gallagher ..... A47C 4/02 297/440.14
7,641,281 B2 * 1/2010 Grimm ..... B60N 2/99 297/452.35 X
9,149,124 B1 * 10/2015 Savovic ..... A47C 7/24
9,723,929 B2 8/2017 Binfare
9,730,520 B2 * 8/2017 Savovic ..... A47C 3/20
10,362,877 B2 7/2019 Binfare
10,368,643 B2 * 8/2019 Savovic ..... A47C 7/28
2017/0332791 A1 * 11/2017 Savovic ..... A47C 3/20
2017/0332792 A1 * 11/2017 Savovic ..... A47C 7/34
2019/0350363 A1 * 11/2019 Savovic ..... A47C 7/20
2020/0275782 A1 * 9/2020 Finazzi ..... A47C 13/005

* cited by examiner

INTERNALLY SUPPORTED CUSHION FOR SEATING SYSTEM

FIELD OF THE INVENTION

The present invention relates to internally supported cushions for seating systems, for example internally supported seat back cushions for wireframe lounge chairs.

BACKGROUND OF THE INVENTION

Upholstered seating cushions, including lounge chairs, are intended for use over extended periods of time. Consequently, it is important to ensure upholstered seating cushions provide ergonomically correct support, and for many different users. Traditionally, upholstered seating cushions include a foam interior, sometimes surrounded by cotton batting or polyester batting, and an upholstery cover. Such seating cushions, while widely used for patio seating and living room seating, are not well suited for use with wireframe lounge chairs however.

In particular, wireframe lounge chairs sometimes lack a rigid seatback or a rigid armrest to support a conventional cushion. Conventional cushions, including upright cushions, can provide insufficient support and slip through gaps in the seatback or armrest. Accordingly, there remains a continued need for an improved seating cushion that can be used with wireframe lounge chairs and other seating systems, the improved seating cushion being easily manufactured to provide ergonomic support for a wide variety of users over extended periods.

SUMMARY OF THE INVENTION

An internally supported cushion for a seating unit is provided. The internally supported cushion includes an internal structure that provides rigidity when used adjacent a back upright or a side upright of a seating unit. The internal structure generally includes a rigid core element that is sandwiched between foam layers. The core element is approximately upright and extends in the lengthwise and widthwise directions of the internally supported cushion. A batting layer is positioned immediately beneath an upholstery covering to prevent the covering from contacting the internal foam layers, which encapsulate the core element.

In one embodiment, a seating unit having an internally supported cushion is provided. The seating unit includes a back upright or a side upright that is supported by a seat support. The internally supported cushion is joined to the seat support and rests against the back/side upright. The cushion includes an upholstery cover that encloses first and second foam layers and a rigid core element. The core element can be planar in some applications, and can be contoured in other applications. The core element is positioned within a pocket between the first and second foam layers. First and second standoffs extend horizontally from the core element, through the second foam layer, to space the core element from the back/side upright. A bracket assembly is joined to the lowermost portion of the core element, the bracket assembly being secured to the seat support by multiple threaded fasteners. The bracket assembly includes a metal bracket in some applications and a wood beam in other applications. The internally supported cushion also includes one or more batting layers beneath the upholstery covering and adjacent the foam layers to give the cushion a pillow-like feel, while the foam layers (as supported by the rigid core) provide ergonomic support for the user.

In another embodiment, a method for manufacturing an internally supported cushion for a seating unit is provided. The method includes joining a bracket assembly and first and second standoffs to a rigid core element. The bracket assembly include a metal bracket in some applications and includes a wood beam in other applications. The first and second foam layers are then joined to opposing sides of the core element, sandwiching the core element therebetween. The core element can be planar in some applications, and can be contoured in other applications. The standoffs extend through openings in the second foam layer, in the direction of a horizontal segment of the side/back upright. The first foam layer optionally includes an outwardly convex curvature separating a upper region from a lower region. The second foam layer includes an outwardly convex curvature that is slightly rounded to mimic the shape of conventional cushions. One or more batting layers is/are then applied over the first and second foam layers, and the assembled unit is placed within a decorative upholstery cover, which includes a zipper along the lowermost surface of the cushion, being hidden from view. The cushion is then joined to a seat support by a plurality of threaded fasteners, which extend through the bracket assembly.

These and other features and advantages of the present invention will become apparent from the following description of the invention, when viewed in accordance with the accompanying drawings and appended claims.

DETAILED DESCRIPTION OF THE CURRENT EMBODIMENT

Figure 1:
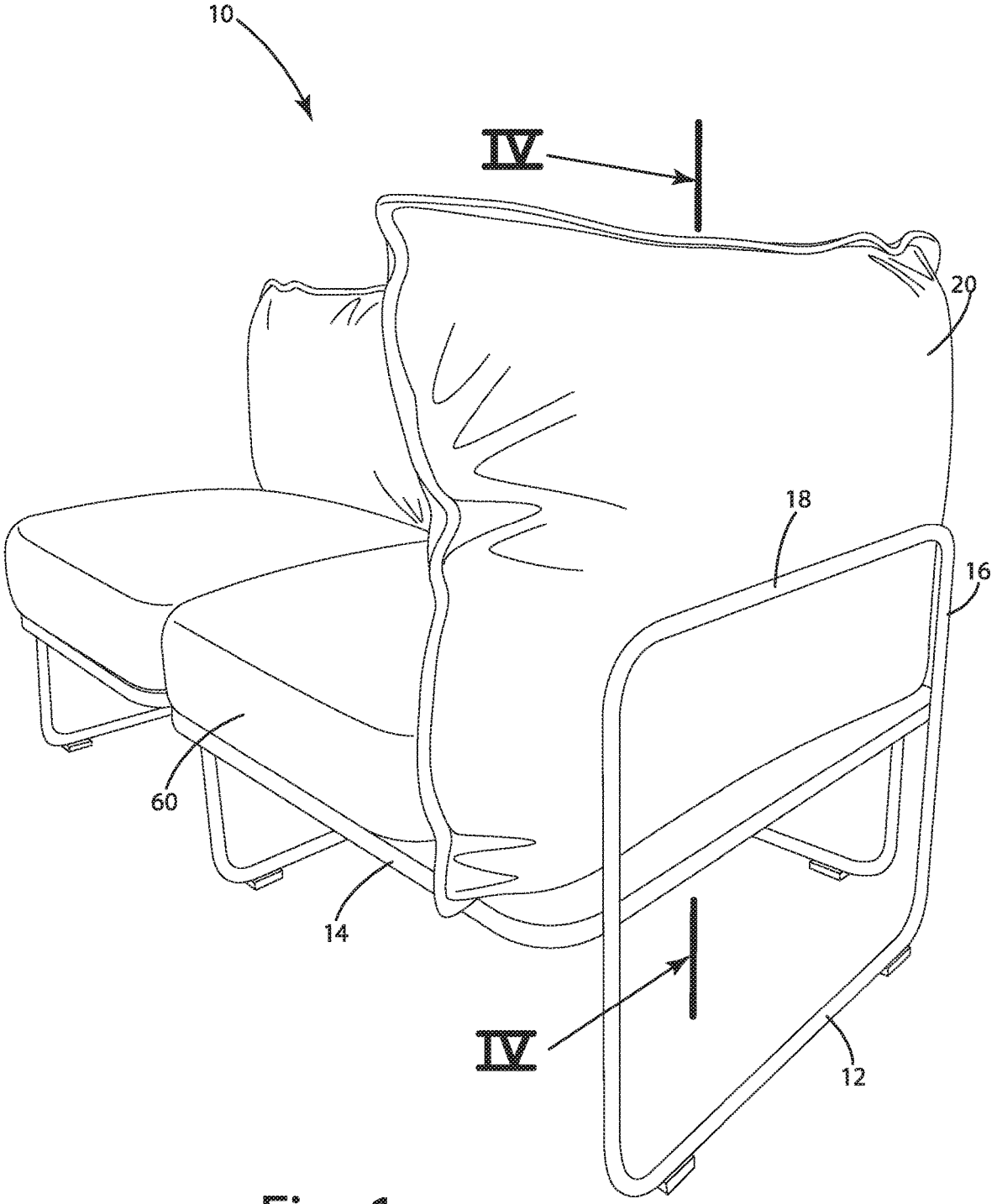
FIG. 1 is a perspective view of a seating unit including an internally supported cushion in accordance with an embodiment of the invention.

Referring to FIG. 1, a seating unit 10 including an internally supported cushion is illustrated. The seating unit 10 is illustrated as a wireframe lounge chair, but can include other configurations in other embodiments, including slatted lounge chairs, traditional lounge chairs, patio chairs, and sofa chairs. The seating unit 10 includes a base 12, a seat support 14 indirectly or directly joined to the base 12, and a back/side upright 16. The back/side upright 16 can be integrally joined to the base 12 as shown in FIG. 1, and can include a horizontal segment 18. The seating unit 10 also includes an upright cushion 20 supported against the horizontal segment 18, the upright cushion 20 having soft outer layers and a rigid core for providing ergonomic support to the user.

Figure 2:
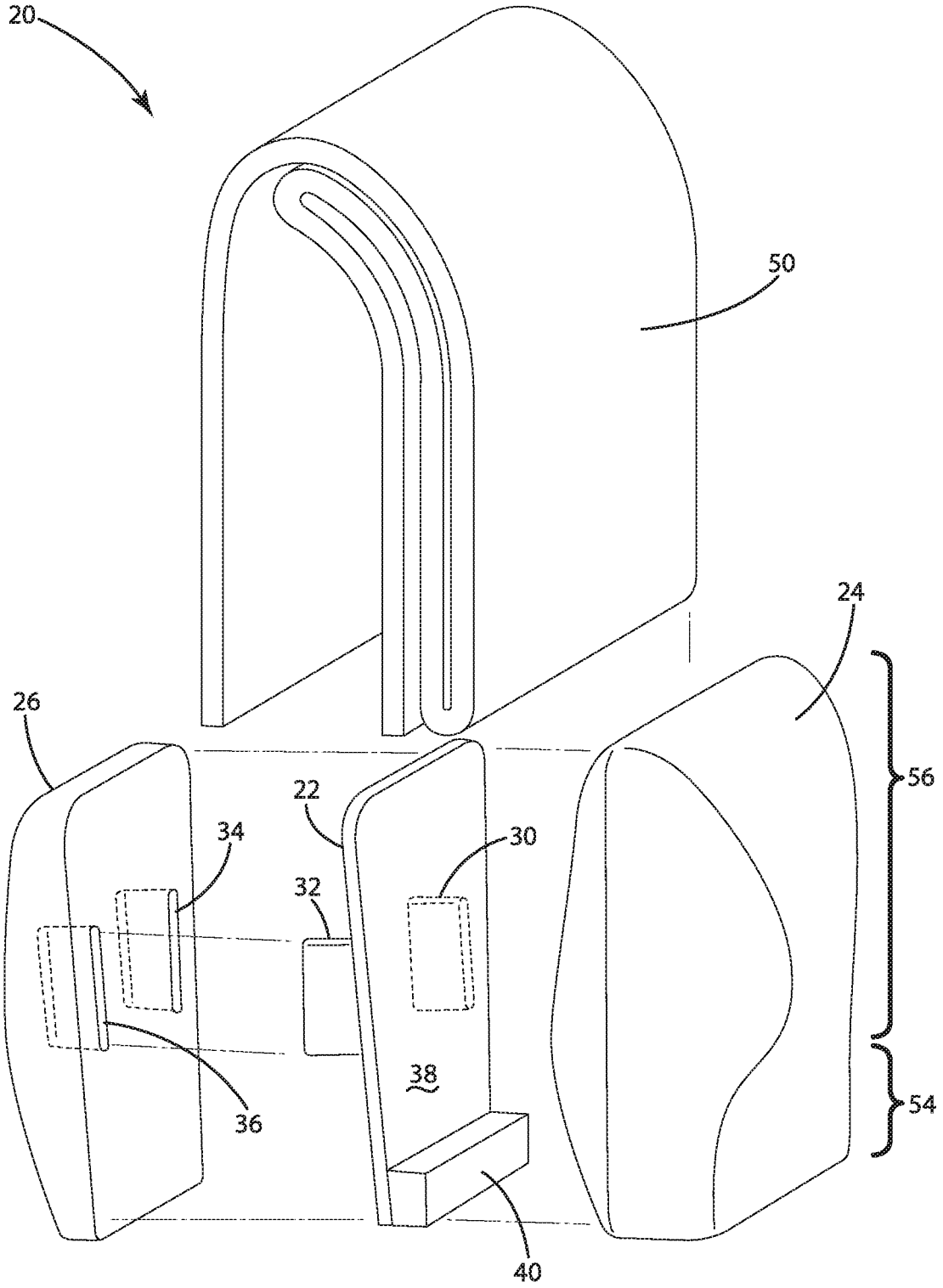
FIG. 2 is a first exploded view of the interior of the internally supported cushion of FIG. 1.
Figure 3:
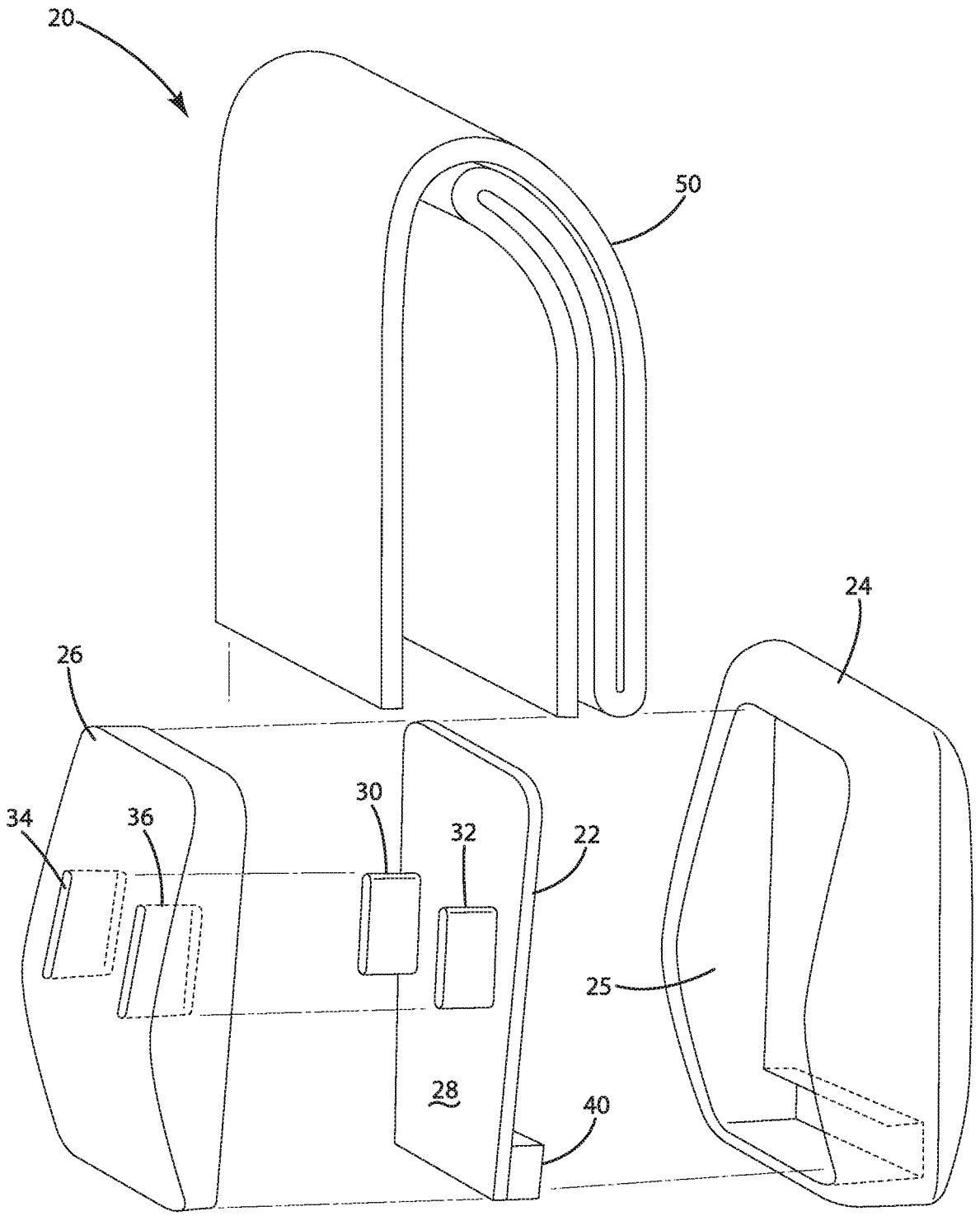
FIG. 3 is a second exploded view of the interior of the internally supported cushion of FIG. 1.

The interior of the upright cushion is shown in FIGS. 2-3. The upright cushion 20 includes a rigid core element 22 received within a cavity between first and second foam portions 24, 26. The core element 22 is generally upright, which as used herein means plus or minus 15 degrees from normal. The core element 22 is illustrated as being a generally plate-like structural element having planar dimensions, but can include other constructions in other embodiments, including a contoured core element to provide ergonomic support. The core element 22 is formed of a sheet of plywood in the present embodiment, but can be formed of other rigid materials, for example ABS plastic or metal. The core element 22 includes a monolithic rectangular construction, lacking beams or articulating elements, and having a thickness of between 0.5 cm and 4 cm, inclusive, further optionally between 1 cm and 3 cm, inclusive. The core element 22 extends in a lengthwise direction and a widthwise direction of the upright cushion 20, but being partially or entirely encapsulated by the first and second foam portions 24, 26. Consequently, the first foam layer 24 comprises a front shell having a recessed opening 25 and the second foam layer 26 comprises a back shell that cooperate to define the internal cavity.

Figure 7:
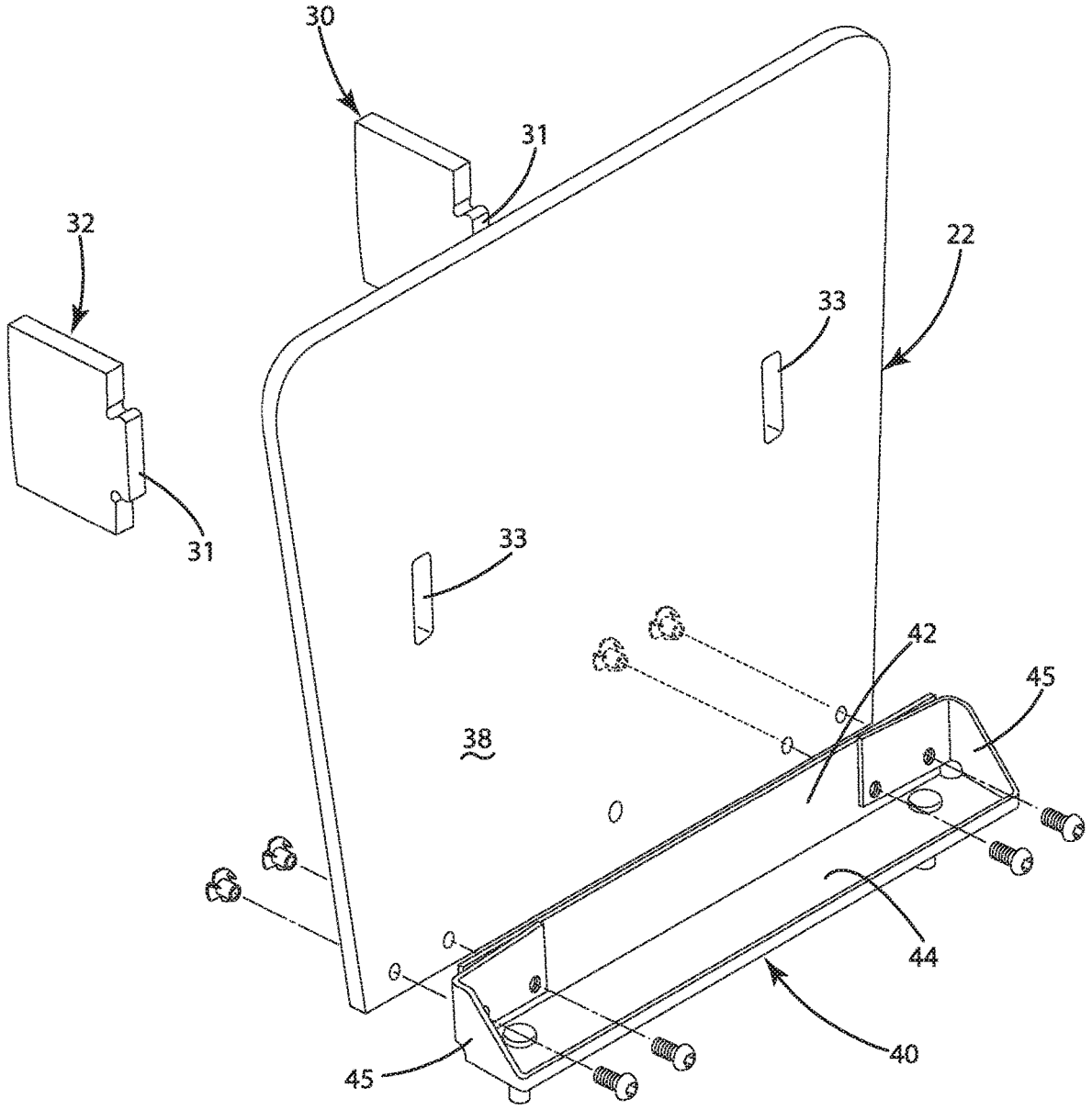
FIG. 7 is an exploded view of an internal support for the cushion of FIG. 5.
Figure 8:
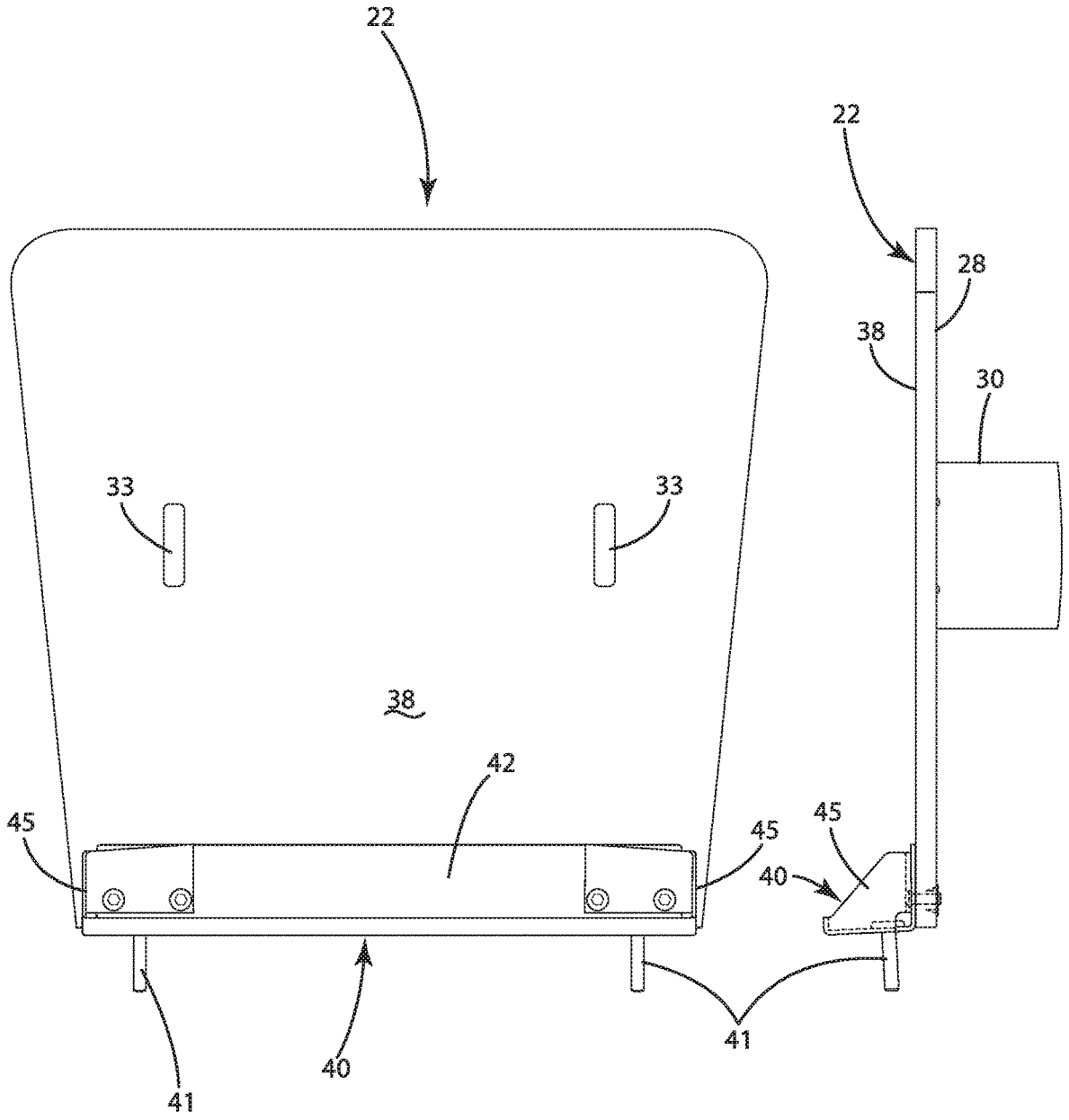
FIG. 8 are plan views of an internal support for the cushion of FIG. 5.

As also shown in FIG. 2-3, the rear-facing surface 28 of the core element 22 is joined to first and second standoffs 30, 32. The first and second standoffs 30, 32 extend from a mid-portion of the core element 22 in the direction of the horizontal segment 18 of the side/back upright 16. The first and second standoffs 30, 32 can be made from any material, for example plywood or a polymeric material, for example a thermoplastic elastomer. The first and second standoffs 30, 32 are received in first and second through-holes 34, 36 in the second foam layer 26, the first and second through-holes 34, 36 extending entirely through the foam layer 26 and being laterally spaced apart form each other. The first and second standoffs 30, 32 are fin-like projections in the current embodiment, being spaced laterally apart from each other but individually oriented vertically, and can include other constructions as desired. As shown in FIG. 7, for example, each standoff 30, 32 includes a base portion 31 that is received within a slot 33 in the core element 22 by interference fit. Functionally, the standoffs 30, 32 maintain a desired spacing between the core element 22 and the horizontal segment 18 of the side/back upright 14.

Figure 6:
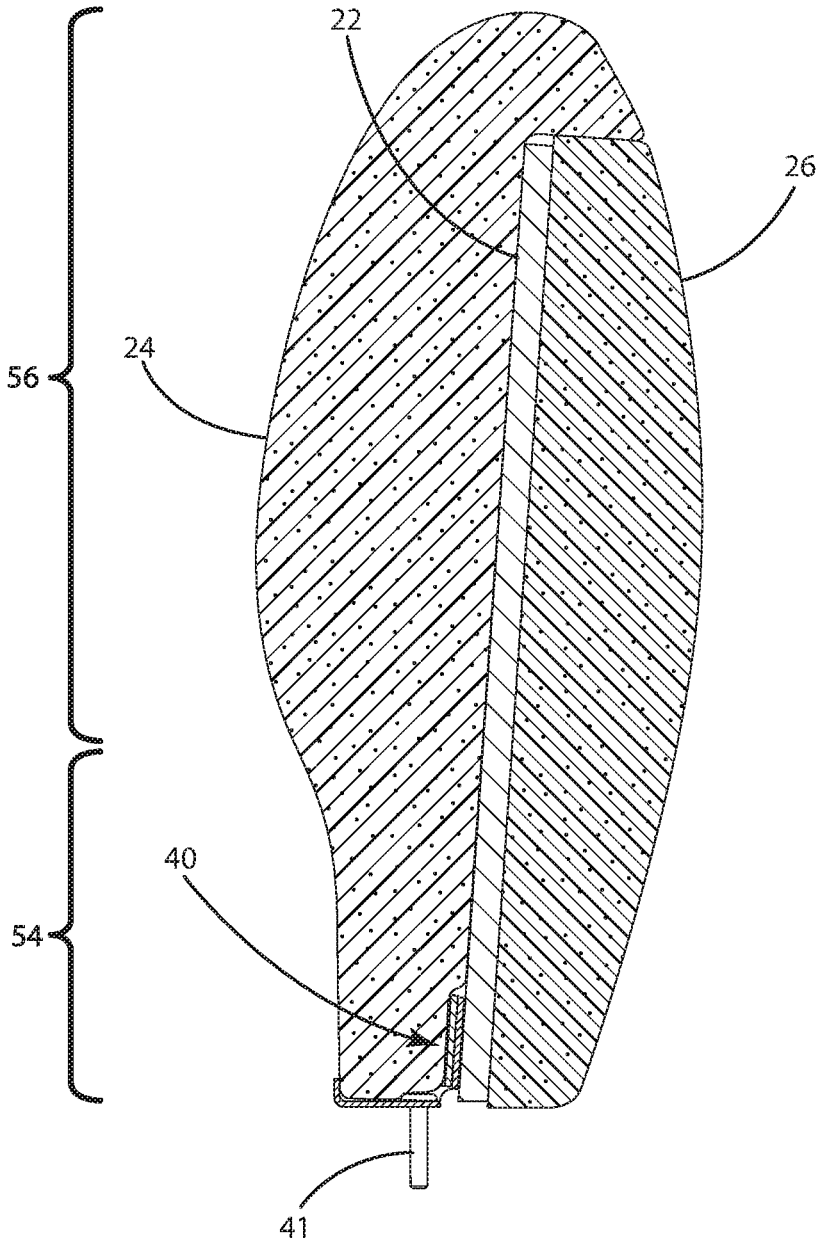
FIG. 6 is a cross-sectional view of the internally supported cushion of FIG. 5.
Figure 9:
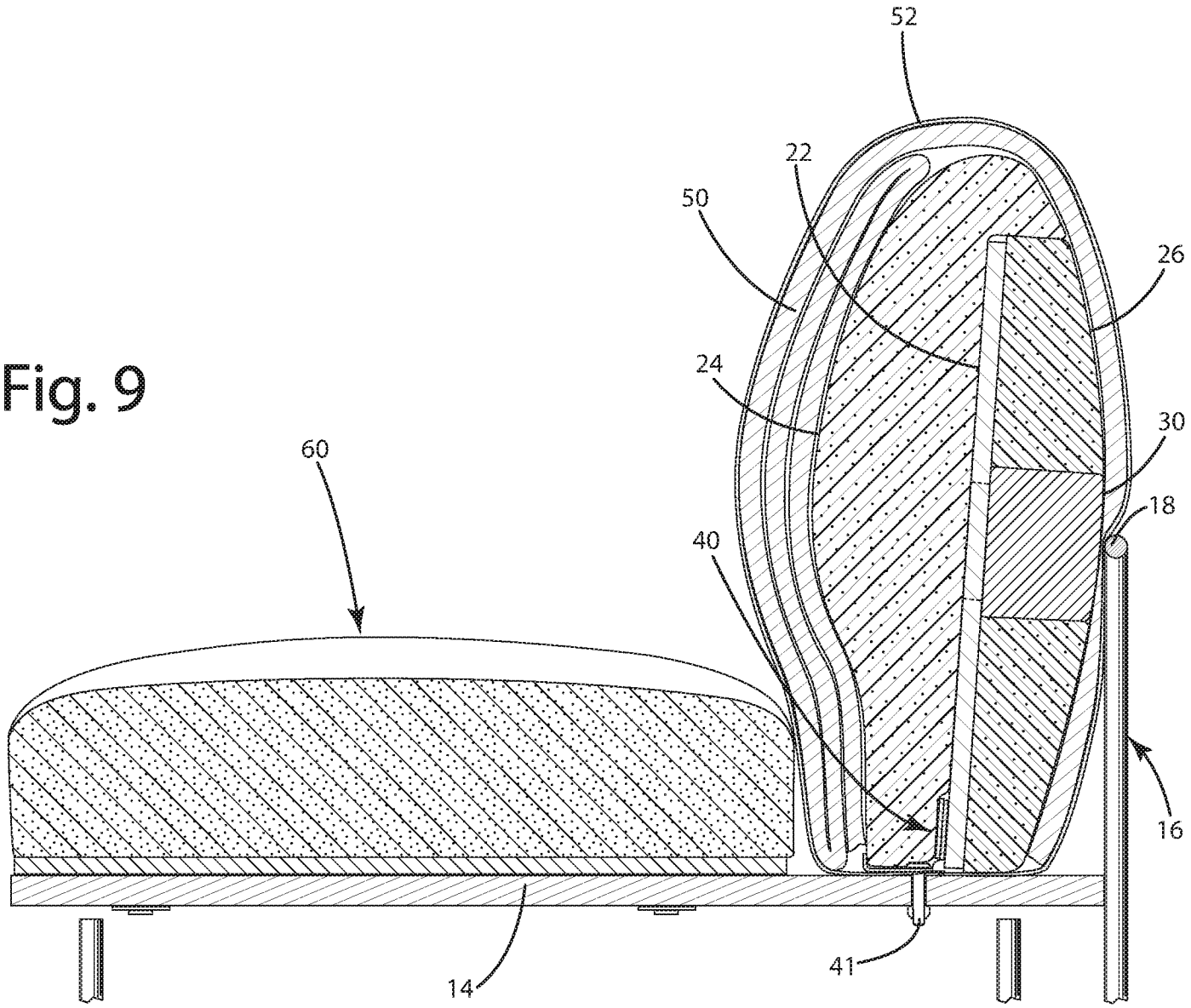
FIG. 9 illustrates a seating unit including the cushion of FIG. 5 in cross-section.

The front-facing surface 38 of the core element 22 is joined to a bracket assembly 40, which is joined to the seat support 14. The bracket assembly 40 includes a wood beam in the embodiment of FIGS. 1-4, being generally rectangular and extending laterally along the width of the core element 22. In this embodiment, the bracket assembly 40 is joined to the core element 22 by a suitable adhesive and is joined to the seat support 14 by a suitable fastener 42. In the embodiment of FIGS. 5-10, the bracket assembly 40 is formed from stamped metal, for example steel, and includes a L-shaped cross-section having a vertical web 42 and a horizontal web 44. Left and right side portions 45 join the horizontal web 44 to the vertical web 42 for additional stability. The lowermost extent of the first foam layer 24 abuts the horizontal web 44 of the bracket assembly 40 in this embodiment, which is shown in FIG. 6. A plurality of threaded fasteners join the vertical web 42 to the front-facing surface 38 of the core element 22 and join the horizontal web 44 of the bracket assembly 40 to the seat support 14. As shown in FIG. 9, these fasteners include threaded bolts 41 extending through the bracket assembly 40 and the seat support 14, being secured in place by threaded nuts 43 on the underside of the seat support 14, hidden from view.

One or more layers of batting material 50 surrounds all or a portion of the first and second foam layers 24, 26, the batting material 50 being interposed between the foam layers 24, 26 and a decorative outer covering 52. The batting material 50 is optionally upholstery-grade polyurethane foam wrapped in polyethylene terephthalate (PET), known by the brand name "Dacron." In the embodiment of FIG. 4, the batting material 50 is optionally folded over itself adjacent the first foam layer 24 to provide additional comfort for the user. In the embodiment of FIG. 9, the batting material 50 is folded onto itself adjacent the first foam layer 24. As alternatively shown in FIG. 10, the batting material includes a thick batting layer 50A adjacent the first foam layer 24 and a thin batting layer 50B adjacent the second foam layer 26. One or both of the foam layers 24, 26 are optionally formed of memory foam, but can be formed of other foam materials in other embodiments. As used herein, memory foam means a slow recovery foam element having a two-dimensional or three-dimensional shape such that, when pressure is applied and released, the slow recovery foam element returns to substantially its original shape. The memory foam can include viscoelastic polyurethane foam and low-resilience polyurethane foam for example. The first foam layer 24 includes an outwardly convex curvature separating a lower region 54 and an upper region 56. The lower region 54 is approximately equal to the height of a seat cushion and includes a concave recess. The upper region 56 provides lumbar support and curves rearward. The second foam layer 26 by contrast includes an outwardly convex curvature that is slightly rounded to mimic the shape of a conventional cushion. Consequently, the foam layers 24, 26 conform to a person's body and maintain an original shape when not in use.

Figure 4:
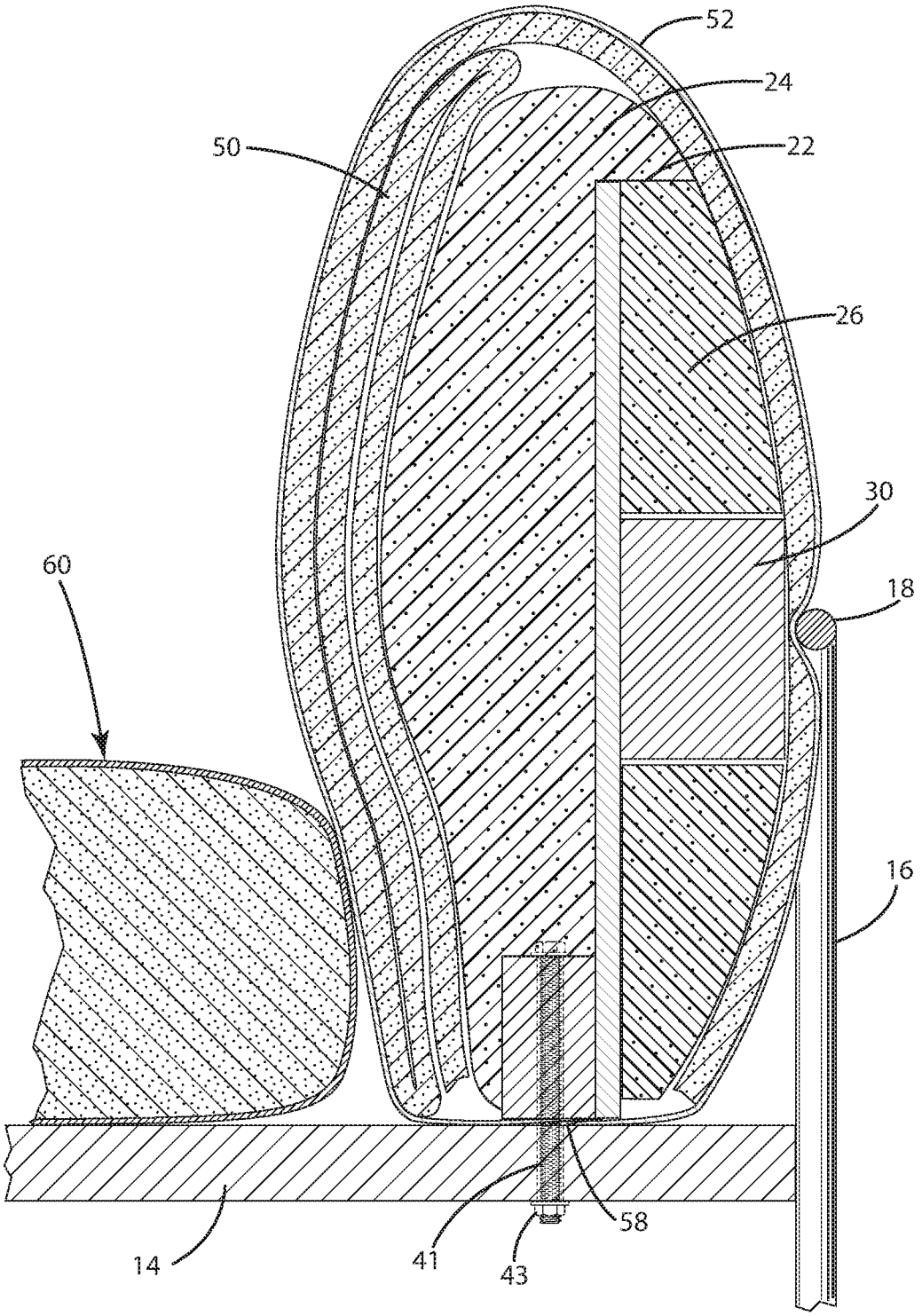
FIG. 4 is a side cross-sectional view of the internally supported cushion of FIG. 1 taken along line Iv-Iv.
Figure 5:
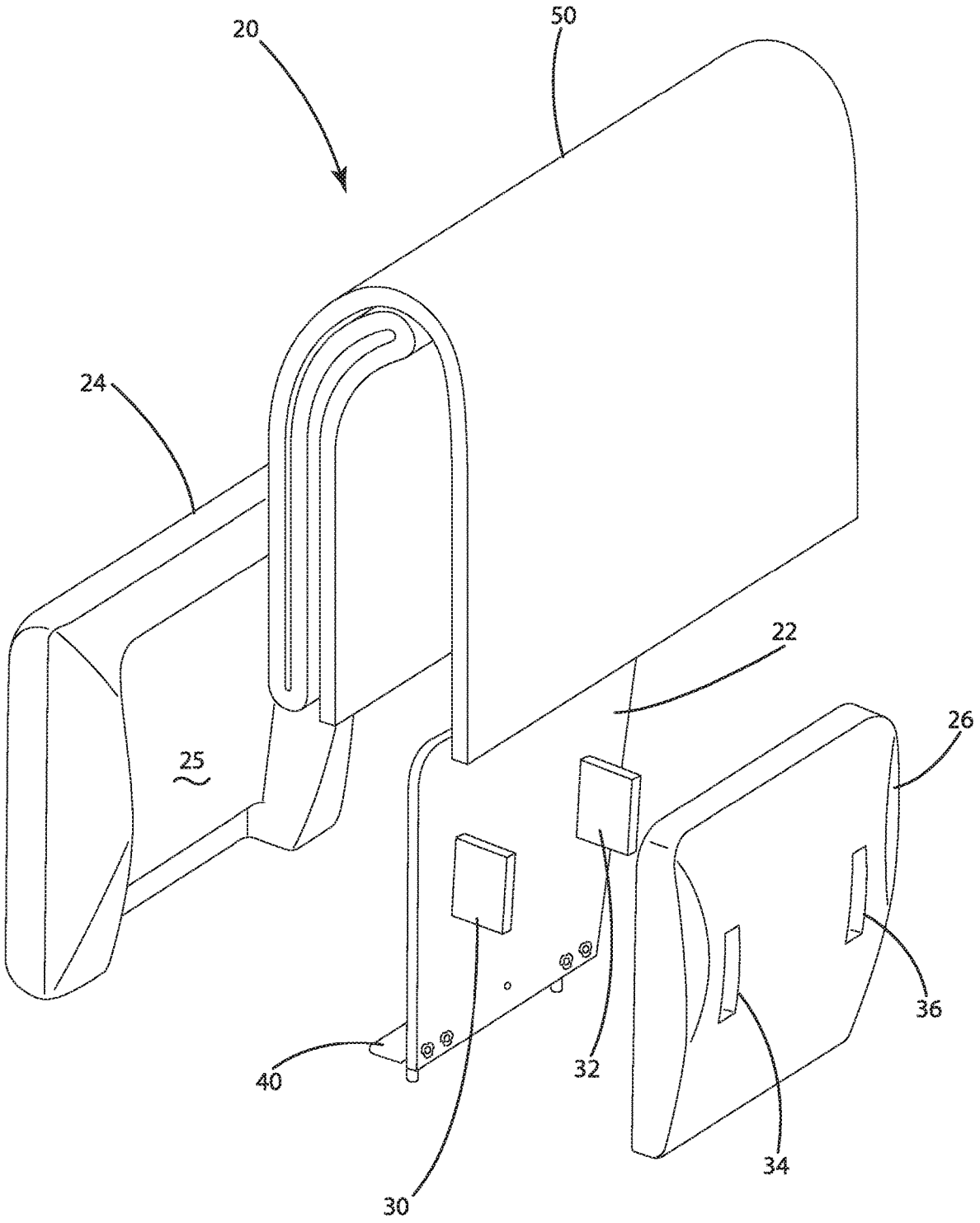
FIG. 5 is an exploded view of an internally supported cushion in accordance with another embodiment.
Figure 10:
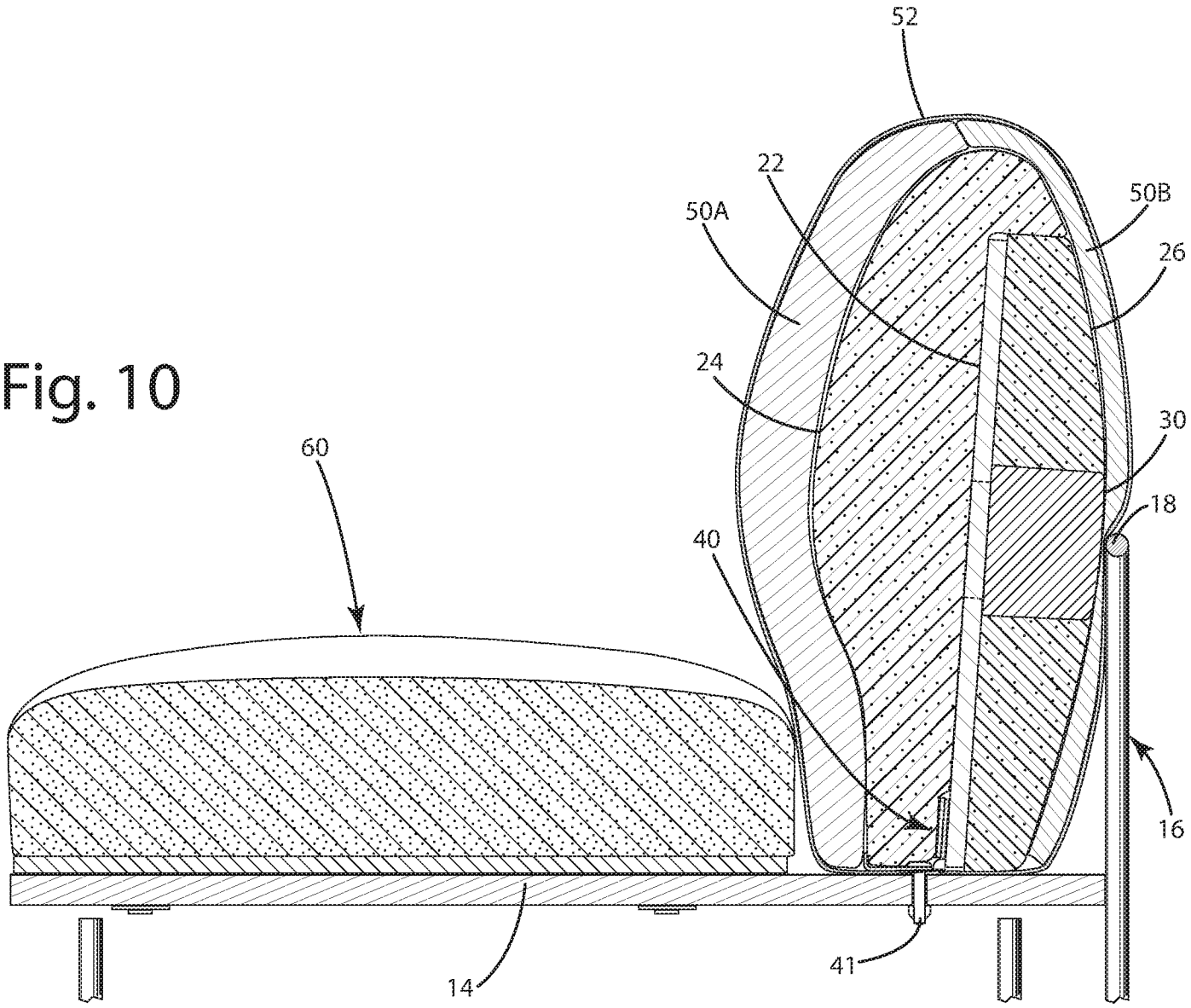
FIG. 10 illustrates the seating unit of claim 9 having two batting portions.

A method for manufacturing the internally supported cushion 20 will now be described. The bracket assembly 40 and the standoffs 30, 32 are first joined to the core element 22. The bracket assembly 40 can include a wood beam as shown in FIGS. 1-4 or a metal bracket as shown in FIGS. 5-9. The first and second foam layers 24, 26 are then joined to opposing sides of the core element 22, sandwiching the core element 22 therebetween. The standoffs 30, 32 extend through openings 34, 36 in the second foam layer 26, such that the standoffs 30, 32 can prevent the second foam layer 26 from collapsing into the horizontal segment 18 of the back/side upright 16. The first foam layer 24 includes an outwardly convex curvature separating a lower region 54 from an upper region 56. The lower region 54 includes a concave indentation to extend around a seat cushion, and the upper region 56 is contoured to provide lumbar support. The second foam layer 26 includes an outwardly convex curvature that is slightly rounded to mimic the shape of conventional cushions. The one or more batting layers 50 are then applied over the first and second foam layers 24, 26 to completely or partially encapsulate the foam layers 24, 26 therein. In some embodiments, a single batting layer 50 is folded onto itself adjacent the first foam layer 24, and in other embodiments, a first batting layer 50A is positioned along the front-facing surface of the cushion and a second batting layer 50B is positioned along the rear-facing surface of the cushion, the first batting layer 50A being thicker than the second batting layer 50B. The assembled unit is placed within a decorative upholstery cover 52, which includes a zipper 58 along the lowermost surface of the cushion 20, being hidden from view. The cushion 30 is joined to the seat support 14 by a plurality of threaded fasteners 41, which threadably engage the bracket assembly 40. The standoffs 30, 32 maintain a desired spacing between the core element 22 and the horizontal segment 18 of the side/back upright 14. The seating unit 10 can include one or more additional cushions, for example a seating cushion 60 as shown in FIGS. 4 and 9-10.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements by ordinal terms, for example "first," "second," and "third," are used for clarity, and are not to be construed as limiting the order in which the claim elements appear. Any reference to claim elements in the singular, for example, using the articles "a," "an," "the" or "said," is not to be construed as limiting the element to the singular.

The invention claimed is:

1. A cushion for a seating unit, the cushion comprising:

an outer cover;

at least one batting layer beneath the outer cover;

a rigid core element having a first surface opposite a second surface;

a first foam layer adjacent the first surface of the rigid core element and a second foam layer adjacent the second surface of the rigid core element, such that the first foam layer and the second foam layer sandwich the rigid core element therebetween;

a bracket assembly including a horizontal web and a vertical web, the vertical web being joined to the first surface or the second surface of the rigid core element, the horizontal web being adapted for attachment to a seat support; and first and second standoffs joined to the second surface of the rigid core element and extending through first and second openings in the second foam layer, wherein the rigid core element extends in a lengthwise direction and a widthwise direction of the cushion.

2. The cushion of claim 1 wherein the first foam layer defines a recess for receiving the rigid core element therein.

3. The cushion of claim 1 wherein the first and second standoffs are vertically oriented fin-shaped projections that are laterally spaced apart from each other.

4. The cushion of claim 1 wherein the first foam layer includes a contoured surface including a convex central portion separating an upper region from a lower region.

5. The cushion of claim 1 wherein the at least one batting layer includes polyester batting or cotton batting.

6. A seating unit comprising:

a base;

a seat support that is supported by the base;

a back upright or a side upright; and a cushion, wherein the cushion is joined to the seat support and includes an upholstery cover at least partially enclosing a first foam layer, a second foam layer, and a rigid core element therebetween, the rigid core element being generally upright and extending in a lengthwise direction and a widthwise direction of the cushion, the cushion including first and second standoffs extending horizontally from the rigid core element, the cushion further including a batting layer between the upholstery cover and the first and second foam layers.

7. The seating unit of claim 6 wherein the first foam layer defines a recess for receiving the rigid core element therein.

8. The seating unit of claim 6 further including a bracket assembly joined to a lower portion of the rigid core element.

9. The seating unit of claim 8 wherein bracket assembly includes a vertical web joined to the rigid core element and a horizontal web joined to the seat support.

10. The seating unit of claim 6 wherein the first and second standoffs are fin-shaped projections extending through first and second openings in the second foam layer.

11. The seating unit of claim 6 wherein the cushion is supported against the back upright or the side upright.

12. The seating unit of claim 6 wherein the first foam layer includes a contoured surface including convex central portion separating an upper region from a lower region.

13. The seating unit of claim 6 wherein the batting layer includes polyester batting or cotton batting.

14. The seating unit of claim 6 wherein the rigid core element includes a width that is coextensive with at least 70% of a width of the upright cushion.

15. The seating unit of claim 14 wherein the rigid core element includes a length that is coextensive with at least 70% of a length of the upright cushion.

* * * * *